US008490340B2

(12) United States Patent
Hatzinikolas

(10) Patent No.: US 8,490,340 B2
(45) Date of Patent: Jul. 23, 2013

(54) SELF-RELEASING STRUCTURAL ASSEMBLY

(76) Inventor: Michael Hatzinikolas, Edmonton (CA)

( * ) Notice: Subject to any disclaimer, the term of this patent is extended or adjusted under 35 U.S.C. 154(b) by 26 days.

(21) Appl. No.: 13/227,915

(22) Filed: Sep. 8, 2011

(65) Prior Publication Data

US 2012/0125646 A1 May 24, 2012

Related U.S. Application Data

(60) Provisional application No. 61/381,205, filed on Sep. 9, 2010.

(51) Int. Cl.
*E04C 1/00* (2006.01)

(52) U.S. Cl.
USPC ..... 52/99; 52/289; 52/96; 52/702; 52/272; 52/279; 52/232

(58) Field of Classification Search
USPC ..... 52/1, 98, 99, 100, 289, 702, 713, 52/272, 279, 283, 254, 167.1, 232
See application file for complete search history.

(56) References Cited

U.S. PATENT DOCUMENTS

| | | | | |
|---|---|---|---|---|
| 5,163,256 | A * | 11/1992 | Fukumoto et al. | 52/167.1 |
| 5,720,571 | A * | 2/1998 | Frobosilo et al. | 403/403 |
| 7,703,244 | B2 * | 4/2010 | Suzuki et al. | 52/167.3 |
| 2003/0159376 | A1 * | 8/2003 | Huynh | 52/208 |

FOREIGN PATENT DOCUMENTS

| | | | |
|---|---|---|---|
| JP | 03279556 | A * | 12/1991 |
| JP | 04343951 | A * | 11/1992 |

* cited by examiner

*Primary Examiner* — Joshua J Michener
*Assistant Examiner* — Matthew Gitlin
(74) *Attorney, Agent, or Firm* — Ostrolenk Faber LLP

(57) ABSTRACT

The end of a transversely extending beam mates to a wall structure by a self-releasing structural assembly. It has a first portion anchored to the wall. A second, fireproof and non-thermally degradable, portion sticks out from the wall. It defines a seat for receiving vertical shear loads from the beam. The assembly also includes a thermally degradable member keyed to the second portion. Both portions have slots for beam end fasteners. The beam fasteners squeeze the end of the beam, the support bracket seat, and the consumable, thermally degradable member in compression. When exposed to heat or flame the consumable, thermally degradable member softens, releasing the tension in the beam end fasteners, and releasing the compression in the parts. The end of the beam can then move away from the wall. The consumable member can be inspected, replaced, and the beam fasteners re-tensioned, without unseating the beam end.

22 Claims, 7 Drawing Sheets

SELF-RELEASING STRUCTURAL ASSEMBLY

Figure 1A:
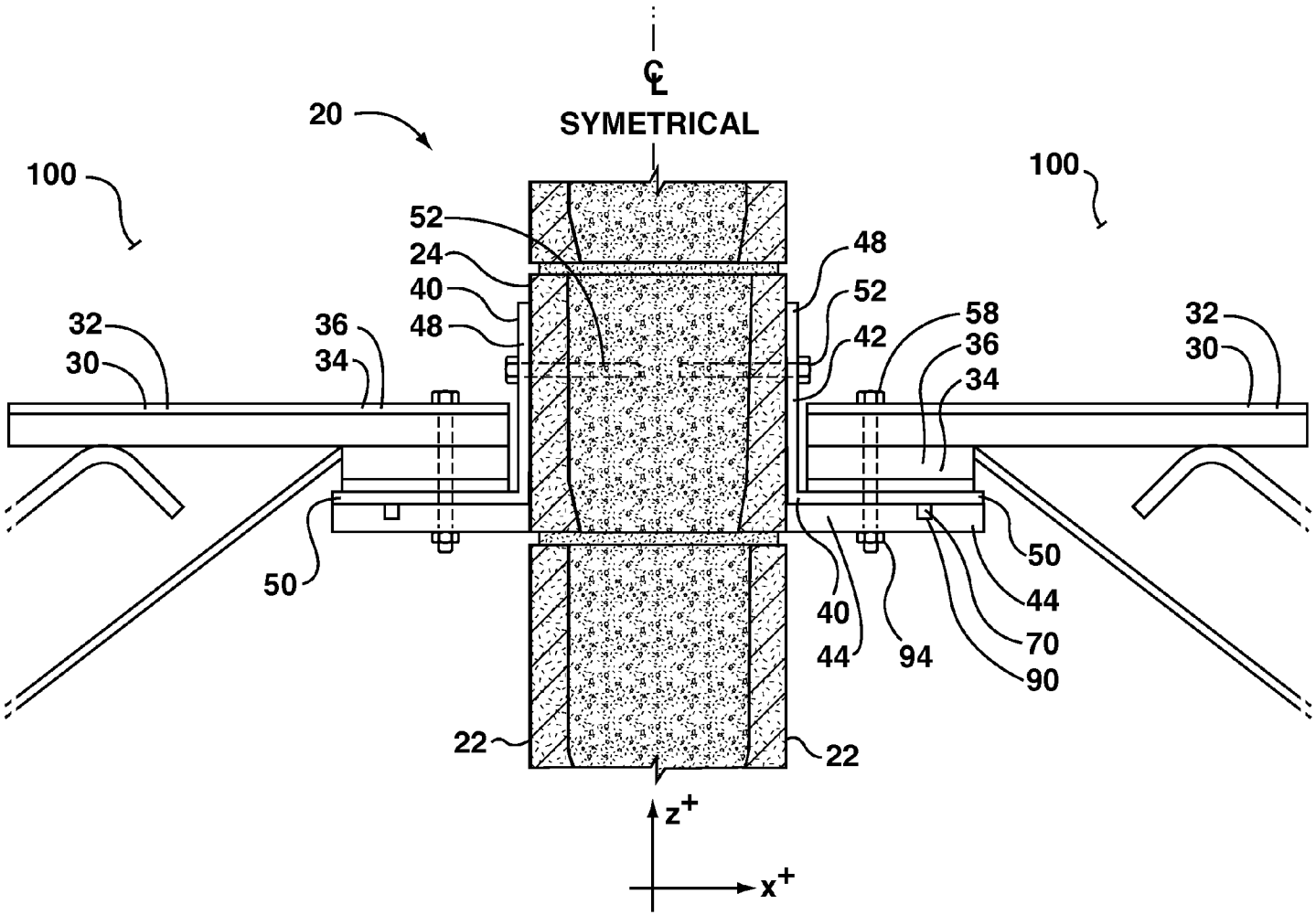

This application claims the benefit of priority under 35 USC 119 or 35 USC 120, or both, as may be applicable, on basis of U.S. Provisional Patent Application Ser. No. 61/381,205 filed Sep. 9, 2010.

FIELD OF INVENTION

This application relates to structural materials for use in the construction of buildings, and, in one particular context, to support structure for joists or other structural cross-members.

BACKGROUND OF THE INVENTION

In building structures it is often desirable to prevent fire from spreading. To that end, two enclosed spaces may be separated by a firewall. The firewall itself may support structural cross-members, such as floor joists for higher floors of the structure. In the event that those floor joists should move, it may be desirable for their dislodgement not also to cause the collapse of the firewall.

To that end, the inventor proposes herein to provide an end support for these beams or joists in the normal course, but then to permit the ends of the joists to release from the firewall in the event of a fire, with the hope that the firewall may then not be damaged and may be able to continue to perform its protective function as a firewall.

SUMMARY OF INVENTION

In an aspect of the invention there is a self-releasing structural support assembly. It has a first member and a second member. The first member is made of a fireproof material. The first member has a first portion and a second portion. The first portion of the first member defines an anchor member by which the first member can be permanently secured to a structural reference datum member, and through which, when installed, a shear load can be passed into the structural reference datum member (i.e., in other words, it provides a load path for, typically, vertical shear loads to be transmitted between a load such as the end of a joist, and a reaction, such as the structural datum reference member.) The second portion of the first member defines a reaction seat upon which to carry a foot of a spanning member and through which to receive a shear load from the spanning member. The second portion of the first member has a spanning member securement accommodation. The second portion of the first member has a first indexing member. The second member is one of (a) fire degradable; and (b) temperature degradable. The second member has a spanning member securement retention fitting that is co-operable with the spanning member securement accommodation. The second member has a second indexing member. On installation, the second indexing member of the second member is positioned in mating co-operation with the first indexing member of the first member. In operation, when so mated, the second member is secured in a position preventing disengagement of the spanning member; and, also in operation, when the second member is degraded by either one of (a) fire and (b) heat, the spanning member is disengageable (i.e., no longer prevented from disengagement) from the first member.

In another aspect of the invention there is a self-releasing beam end support assembly. It includes a support fitting and a consumable member. The support fitting defines a seat upon which to support a beam end, and an anchor by which to attach the support fitting to a wall structure. The consumable member and the support fitting have co-operating beam fastener accommodations. The consumable member and the support fitting have mutually co-operating engagement fittings constraining location of the consumable member relative to the support fitting. The consumable member is one of (a) thermally degradable; and (b) fire degradable. In operation, under a first, non-degraded condition of the consumable member, the support fitting and the consumable member are co-operable with the beam fastener to discourage dislodgement of the beam end from the seat. Also in operation, under a second, degraded condition of the consumable member, the support fitting and the consumable member are co-operable to permit release of the beam end from the seat.

In an additional feature of either of those aspects of the invention, when installed, the seat is upwardly facing and the consumable member is located below the seat. In another feature, as installed, the condition of the consumable member is ascertainable, and the consumable member is replaceable while the beam end remains supported by the seat. In still another feature, the support fitting is mountable to a substantially planar wall, and, when mounted to such substantially planar wall, the beam fastener accommodations of the support fitting have a degree of freedom of linear translation substantially normal to the wall, and the seat has a range of accommodation position for the beam end along the degree of freedom. In a further feature, the range of accommodation is at least 2 inches long.

In another additional feature, the support fitting is one of (a) an angled member having a first leg for mounting to a wall, and a second, cantilevered leg that stands outwardly of the wall when the first leg is mounted thereto; and (b) a channel member having two legs and a back extending therebetween, such that when the channel member is embedded in a wall the back thereof is substantially horizontal and defines the seat. In still another feature, the support assembly is combined with embedment anchor hardware, the anchor member having fittings defined therein co-operable with the hardware. In still another feature, there are beam engagement fittings. The beam engagement fittings are threaded fasteners. The accommodations define slots. In use, the support fitting, the consumable member and a beam end are stacked together in a sandwich, and the threaded fasteners secure the sandwich, the sandwich being in compression and the threaded fasteners being in tension. In a further feature, the combination includes the beam.

BRIEF DESCRIPTION OF THE ILLUSTRATIONS

Figure 1B:
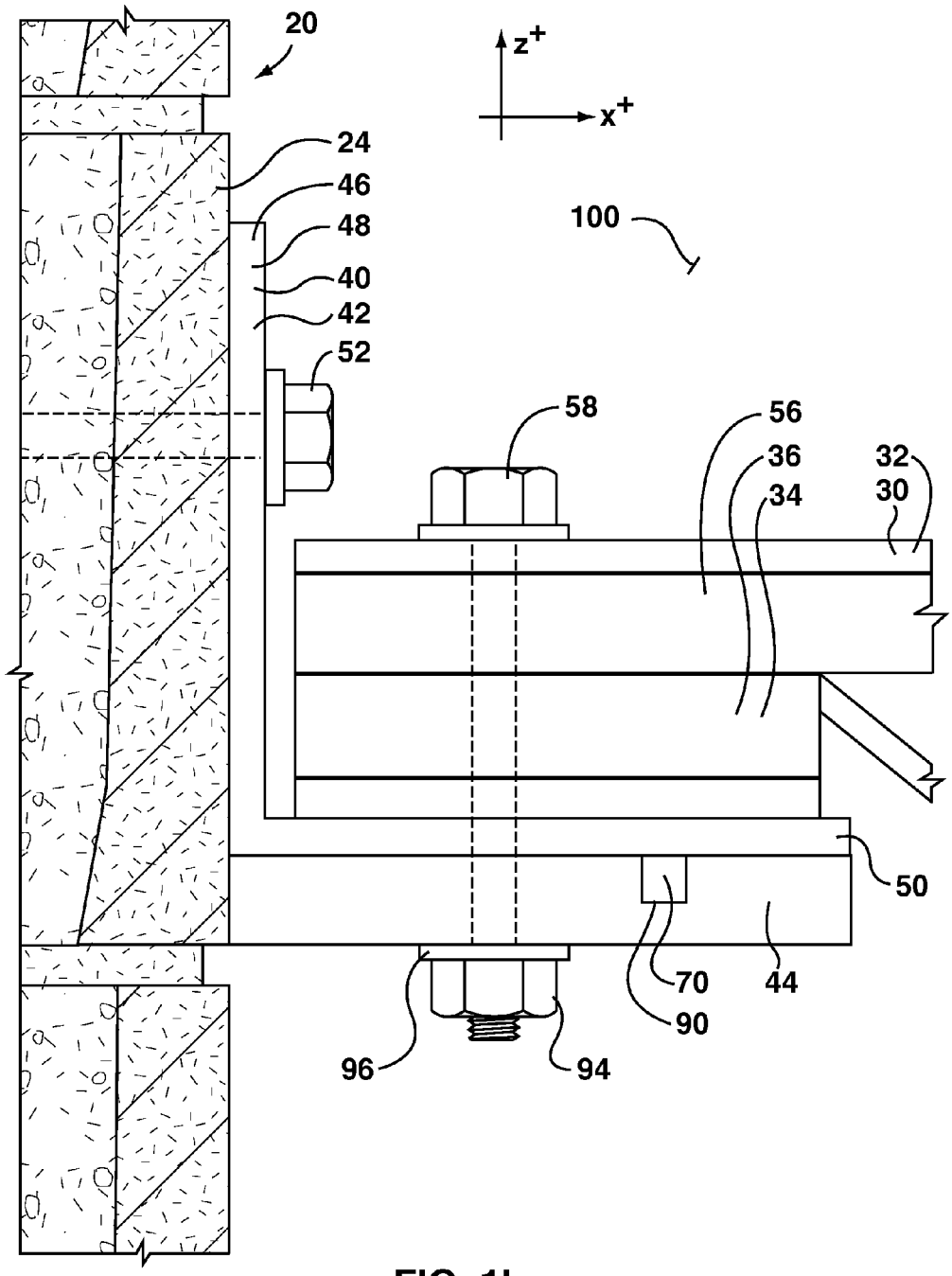

The foregoing aspects and features of the invention may be explained and understood with the aid of the accompanying illustrations, in which:

FIG. 1*a* is a general arrangement view through a cross-section of a structural load-bearing firewall showing two beam end support assemblies in side view according to an aspect of the invention;

FIG. 1*b* is an enlargement of a detail of one of beam end support assemblies of FIG. 1*a;*

Figure 2A:
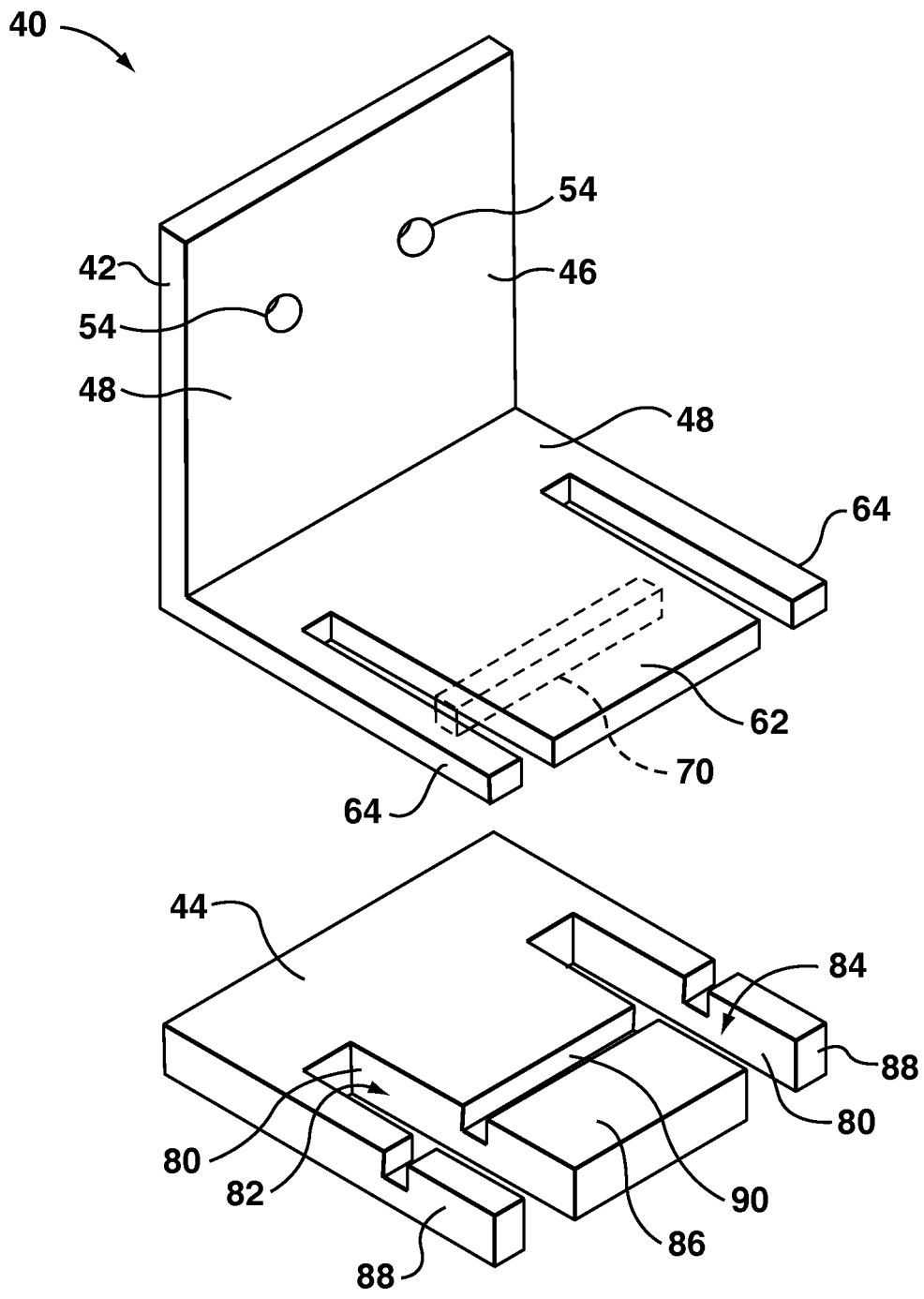

FIG. 2*a* is an exploded isometric view of parts of the support assembly of FIG. 1*b;*

Figure 2D:
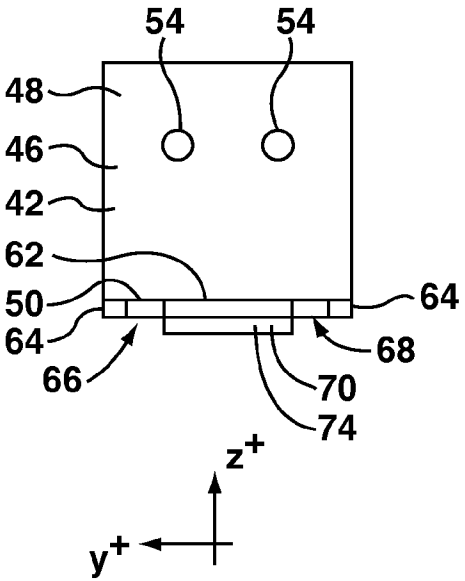
Figure 2G:
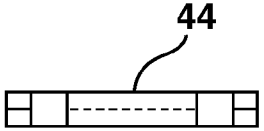
Figure 2C:
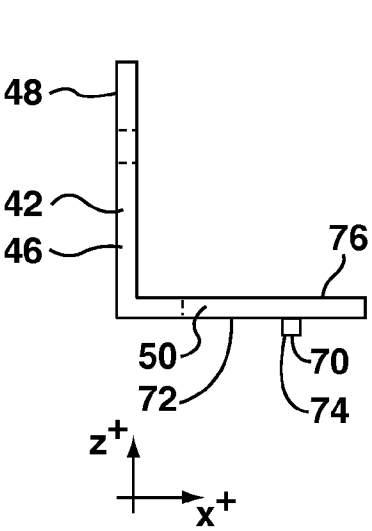
Figure 2F:
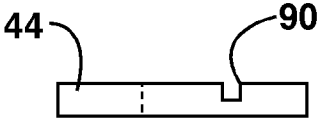
Figure 2B:
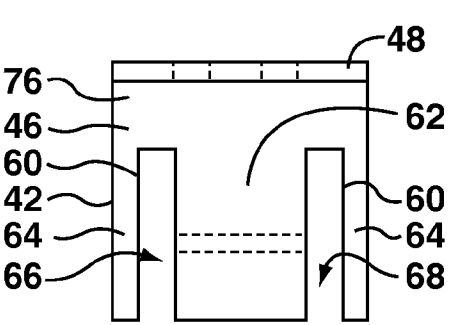

FIG. 2*b* is a top view of a bracket member of the assembly of FIG. 2*a;*

FIG. 2*c* is a side view of a bracket member of the assembly of FIG. 2*a;*

FIG. 2*d* is a end view of a bracket member of the assembly of FIG. 2*a;*

Figure 2E:
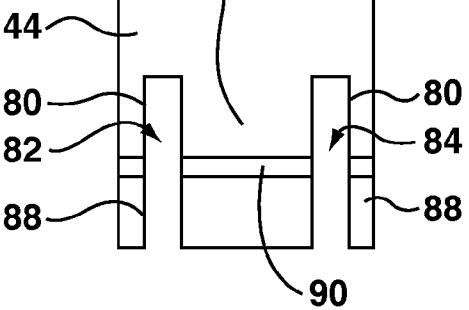

FIG. 2*e* is a top view of a slip plate member of the assembly of FIG. 2*a;*

FIG. 2*f* is a side view of the slip plate member of the assembly of FIG. 2*a;*

FIG. 2*g* is a end view of the slip plate member of the assembly of FIG. 2*a;*

Figure 2H:
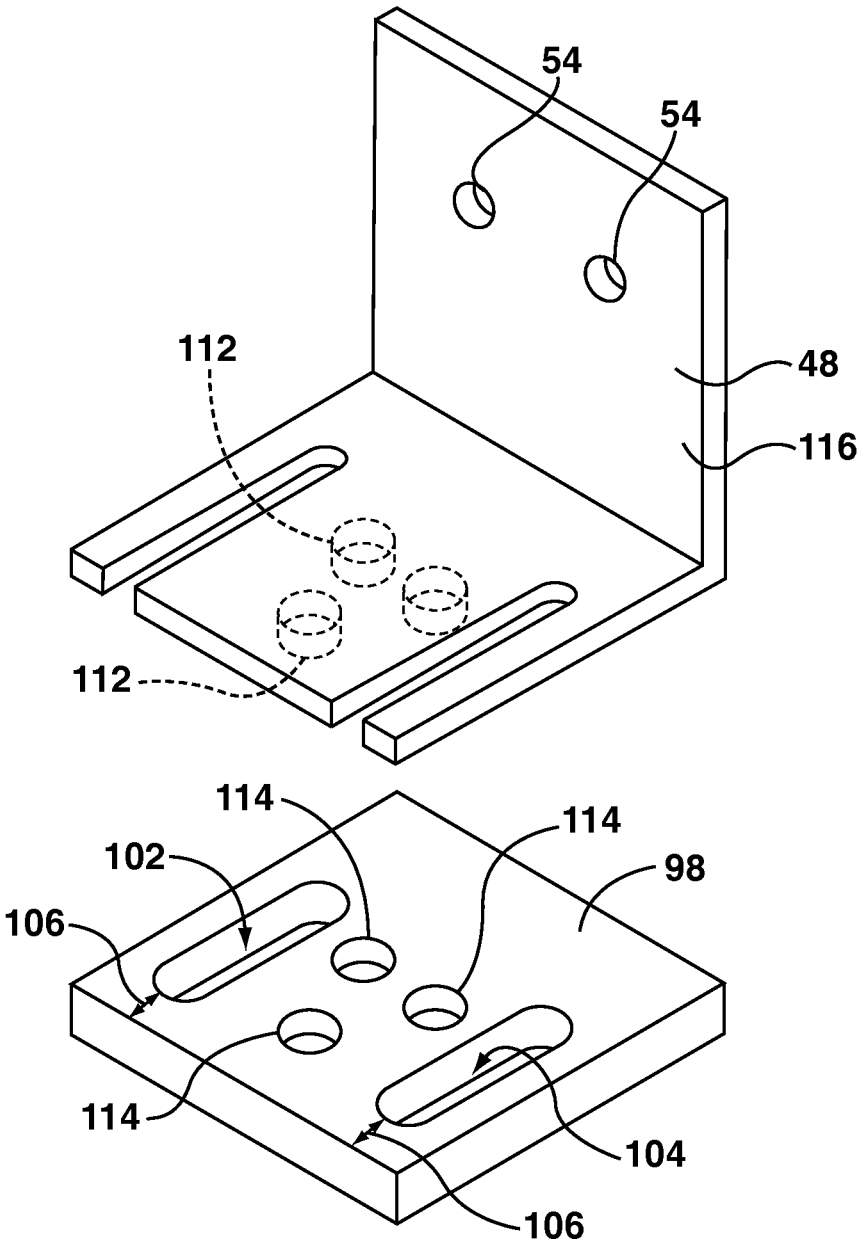

FIG. 2*h* is an exploded isometric view of an alternate embodiment of hanger bracket assembly of FIG. 2*a;*

Figure 3A:
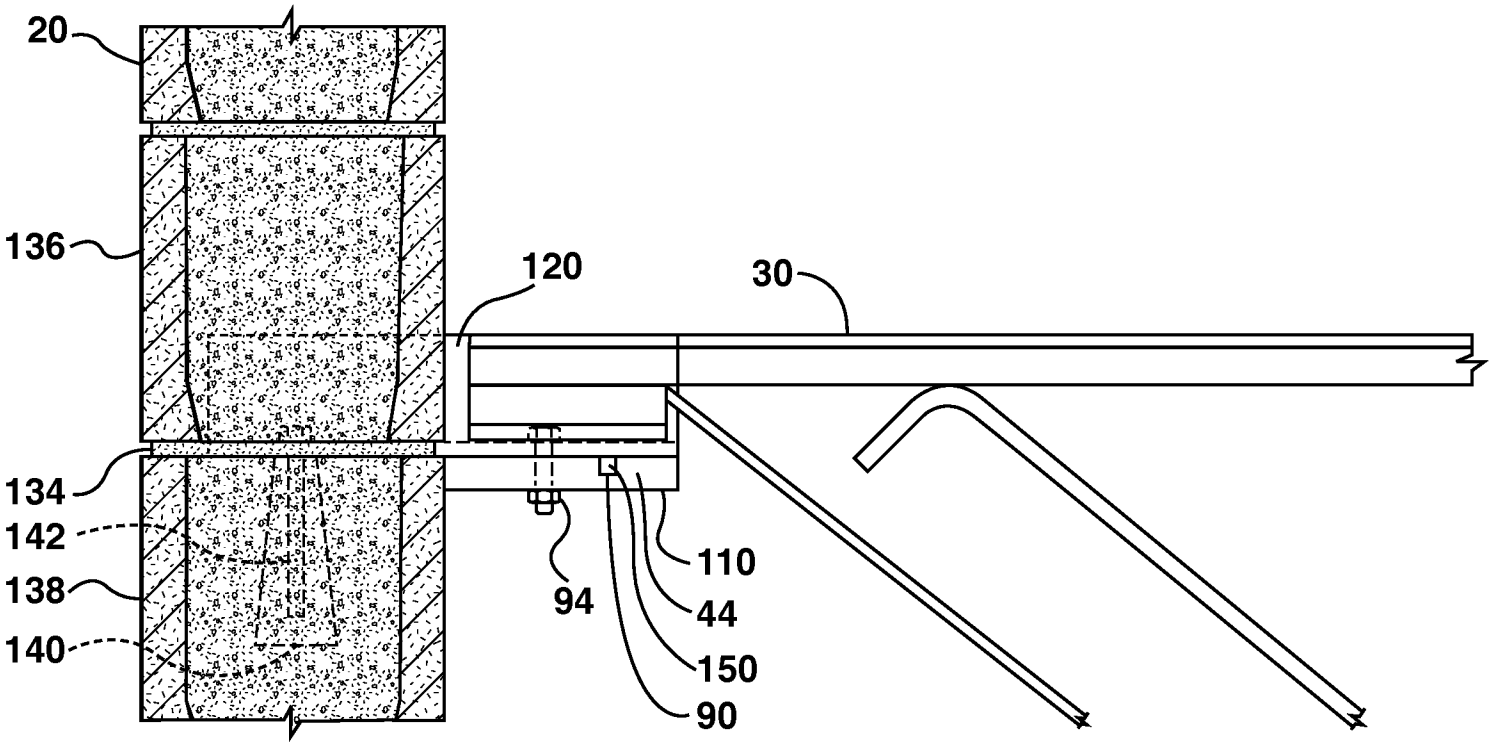

FIG. 3*a* is a general arrangement view through a cross-section of a structural load-bearing firewall showing an alternate beam end support assembly to that of FIG. 1*a;*

Figure 3B:
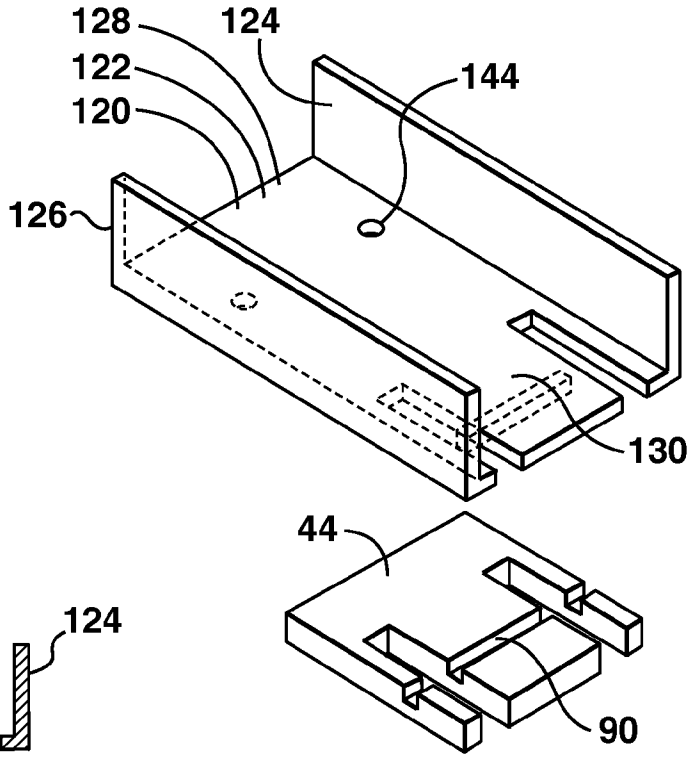

FIG. 3*b* is an exploded isometric view of parts of the support assembly of FIG. 3*a;*

Figure 3E:
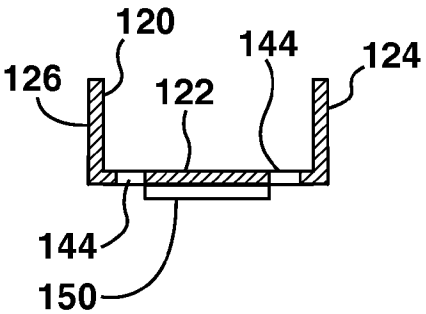
Figure 3C:
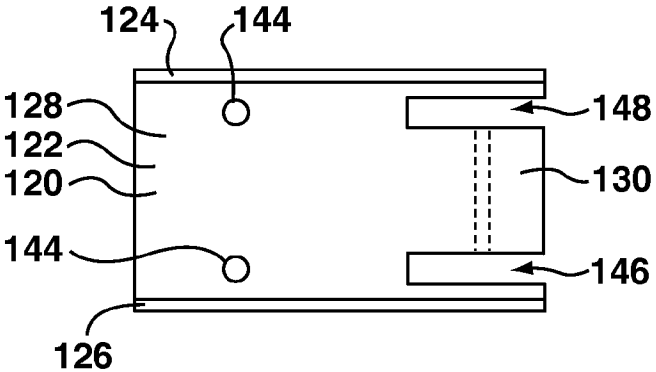

FIG. 3*c* is a top view of a bracket member of the assembly of FIG. 3*a;*

Figure 3D:
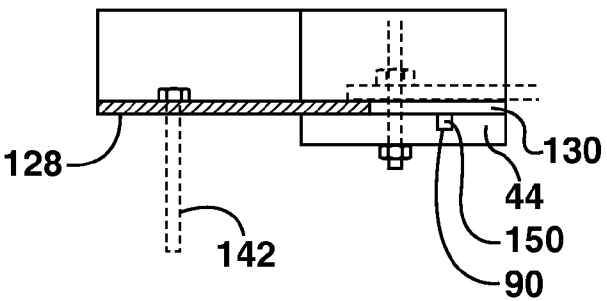

FIG. 3*d* is a side view of a bracket member of the assembly of FIG. 3*a; and*

FIG. 3*e* is an end view of a bracket member of the assembly of FIG. 3*a.*

DETAILED DESCRIPTION

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings may be taken as being to scale, or generally proportionate, unless indicated otherwise.

The terminology used in this specification is thought to be consistent with the customary and ordinary meanings of those terms as they would be understood by a person of ordinary skill in the art in North America. Following from the decision of the Court of Appeal for the Federal Circuit in Phillips v. AWH Corp., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of experience in the art.

Reference is made herein to fireproof materials. For the purpose of this specification, a material may be considered fireproof if its physical properties are such that it will neither catch fire nor melt below 600° C. Fireproof materials explicitly include metals such as are commonly used in building materials, such as iron, steel, nickel, copper, brass, bronze, aluminum, and such other various metal alloys as may be used commonly for construction materials. In the most common context, the fireproof material may be mild steel.

In this specification, reference is made to materials that are either flammable or that degrade in the presence of heat. For the purposes of this description, flammable means flammable under commonly occurring circumstances up to 500° C. This would include lignocellulosic materials, e.g., wood and paper based materials, and many hydrocarbon based plastics. For the purposes of this description, the term heat degraded or heat degradable means a material that loses properties pertaining to physical integrity when heated substantially above room temperature, e.g., heated well above 100° C. Those properties may include degradation as by melting, or by undergoing plastic deformation; it may include loss of yield strength or other forms of physical weakening.

Referring to the general arrangement of FIGS. 1*a* and 1*b*, there is a partial cross-section of a wall assembly 20, the wall assembly including, or being, a masonry firewall. For the purposes of this description it may be helpful to consider a Cartesian co-ordinate frame of reference. The vertical or up-and-down direction may be designated as the z-axis or z-direction. The perpendicular direction lying in the plane of the page may be considered as the longitudinal direction or x-direction or x-axis. The mutually perpendicular direction normal to the page, i.e., along the wall, may be considered the sideways, or y-direction or y-axis.

The masonry firewall has some form of facing, 22. The masonry firewall may be made of reinforced concrete, filled cinder blocks, brick, and so on. Wall assembly 20 is of some height. It starts at a level some distance below the section shown, and extends to a level some distance above the section shown. The middle portion of the section in the z or vertical direction may be considered to be a course of cinder blocks, 24. As may be understood, masonry firewalls are often intended to be strong in the vertical direction, as they may be intended generally to carry vertical loads in compression. They may not be intended to transmit bending moments, and may not be intended to receive substantial transverse loads normal to the wall, the walls often being substantially planar with large height and width but relatively much thinner through-thickness (i.e., the through-thickness may be one or more orders of magnitude smaller than the other dimensions).

On either side of wall assembly 20 (i.e., in the x-direction) there may be assumed to be floors, or substantially horizontal supporting platforms of one kind or another. These platforms are assumed to be supported in some way by span-wise extending support members 30, where the span-wise direction is taken as being the x-direction. For the purposes of this description, support members 30 may be termed support beams or trusses, or joists 32. These joists 32 may, for example, include non-flammable structural elements such as steel flanges and struts. Joists 32 may have beam ends 34 that have the form of a flat, or tab, or finger 36.

A cross-member end support, such as may be identified as a self-releasing structural support assembly, may be identified as 40. Support assembly 40 may also be termed a joist hanger, or hangar bracket assembly. As seen in FIGS. 2*a*-2*g* support assembly 40 may include a first part, such as may be the hanger or bracket itself, or simply the hanger, identified as 42, and a second portion or second part, which may be a flammable or heat degradable member, or consumable member, identified as 44. It may be noted that while support assemblies 40 may be mounted on opposite sides of wall assembly 20, neither assembly traverses the wall structure, such that fire cannot be transmitted across the masonry wall by the fitting installation itself.

The hanger or bracket 42 may have the form of an angle bracket 46 which may include a first portion or member or first leg, 48, that stands substantially vertically, and a second portion or member, or second leg, 50 that lies in a substantially horizontal plane. Hanger 42 is made of a fireproof material that will tend not to burn or suffer thermal degradation in fire conditions. For example, hanger 42 may be made of steel.

The first portion, first leg 48, is an anchor member. That is, first leg 48 is the portion of hanger 42 that is the base, or anchor, that, on installation, is permanently secured or otherwise attached to the fireproof structural reference datum member such that loads carried by hanger 42, namely the vertical shear load introduced by the end of the spanning member, are transmitted into the reaction member, namely the masonry wall. The structural datum member in this example is the fireproof wall assembly 20. The connection may involve mechanical embedment of a portion or all of the anchor member into the masonry wall, or it may involve the use of mechanical securement hardware or other fittings, of which an embedded anchor bolt, or laterally spaced apart anchor bolts, 52 may be taken to be generically representative. To that end first leg 48 may have an anchor or attachment fitting, or fittings, such as bores 54 (FIG. 2*a*) that are laterally spaced from each other.

The second portion, second leg 50, is a short cantilever beam whose length is of a magnitude roughly comparable to its width. Leg 50 defines a reaction seat upon which to carry the foot, or toe, or tab, or tang or end 34 of spanning member 30, and through which to receive the vertical shear load from spanning member 30. There will, typically, be a mechanical fastener, or link, or pin, fitting, or connector that in some way secures the end of the spanning member to the support bracket. In the example illustrated, the flanged end 56 may have suitable bores for mechanical retainers in the form of threaded fasteners such as may be identified as bolts 58. Second leg 50 may have spanning member securement fitting accommodations 60 in FIG. 2*b* that align with, and receive, those retention fittings. In the example illustrated, second leg 50 has a central portion 62 and two flanking fingers, 64, that extend parallel to central portion 62, but are laterally spaced from it such as to leave two laterally spaced apart slots 66, 68 that define accommodations 60 in this embodiment. Slots 66, 68 may be closed at their inner or proximal ends close to first leg 48, and are open at their far or distal legs distant from first leg 48. The length of slots 66, 68 provides a range of dimensional tolerance of variation of position in the x-direction, namely the spanning direction perpendicular to the wall, of the end of the spanning member. That range may typically be +/−1 inches to either side of center, giving an overall range of at least 2 inches. In addition, these slots are also open in the end direction, such that bolts 58 can, unless otherwise discouraged, slide out in the x-direction.

Second leg 50 also includes a retainer, or retention fitting or first indexing member 70, which may have any of a multitude of physical forms but may, in one example, have the form of a short length of rod or bar 74, welded cross-wise to the underside, or under-surface, 72 of leg 50. In other embodiments indexing member 70 might have the form of a round plug or blister, or a pattern or array of such protuberances (indicated in phantom as 112 in FIG. 2*h*) extending proud of the otherwise generally horizontal planar under-surface 72 of leg 50. In normal use the end of the spanning member may sit on the upwardly facing surface or side 76 of leg 50.

Second part or member 44 may, as noted, be a flammable or heat degradable member. It may, generally speaking, have a plan form or footprint conforming to, or otherwise suitable for co-operation with, the under-surface 72 of leg 50. It may be convenient that this foot print be substantially square or rectangular and correspond in length and width to leg 50 of bracket 46. Second member 44 is made of a material that is either (a) fire degradable; or (b) temperature degradable. That is, when exposed to either sufficient heat or to open flame the structural integrity of second member 44 diminishes, and its yield, modulus, or strength may lessen, and it may undergo plastic deformation. Second member 44 has a body that has a spanning member securement retention fitting, or fittings 80, that is, or are formed therein, those fittings being co-operable with spanning member securement accommodations 60. For example, where fittings 60 are slots 66, 68, fittings 80 may also be slots, 82, 84, correspondingly shaped and spaced between a central portion 86 and laterally spaced fingers 88. In one embodiment, slots 82, 84 may be open-ended at the end most distant from first leg 48 of bracket 46. In the alternate embodiment of slip plate 98 of FIG. 2*h*, slots 102, 104 are apertures formed through the body of slip plate 98. Apertures 102, 104 have a closed periphery or closed peripheral wall. Between the distal end of the slots and the end of the slip plate is a small portion of material, or a membrane, designated as 106, membrane 106 being frangible when slip plate 98 has been exposed to high heat or open flame and the tension and compression in the bolted sandwich assembly has been released.

Second member 44 may be termed a slip plate. Second member 44 has a retainer or x-direction retention fitting retention or indexing member 90 that is of a size and shaped matingly to engage the retention or indexing member 70 of first member 42. In the embodiment illustrated indexing member 90 may have the form of a slot, or rebate, or depression that is the negative image of and thereby defines an accommodation for member indexing member 70. It is to some extent arbitrary which of indexing members 70 and 90 is termed the male member, and which is termed the female member. The two parts engage, and when so engaged the two parts cooperate such that second part, member 44, is inhibited from movement in the release or x-direction.

Second member 98 may have retainers, or retention fittings, or indexing fitting such as indexing member 90, or it may have such other pattern as may suit. For example, member 98 may have an array of rebates, or defects, or hollows or depressions, such as may be identified as sockets or receptacles 114 as shown in FIG. 2*h* for receiving protuberances 112 of alternate bracket 116.

When assembled, the end of spanning member 30 sits on the seat defined by upper surface 76 of cantilevered leg 50 of bracket 46. The end fasteners, such as threaded bolts 58, pass through the bores in the end of the spanning member, through slots 66, 68 in leg 50, and through slots 82, 84 in second member 44. In the resultant sandwich, bolts 58 are secured in place by nuts 94 which may also bear against a washer or a load-spreading keeper plate 96. Nuts 94 are then tightened to impose tension in bolts 58 (and corresponding compression in the sandwich) such that there is a suitable friction load between the end of spanning member 30 and supporting bracket 46 to retain the end 34 of spanning member 30 in place. In normal circumstances, under ordinary loading conditions there should not be any longitudinal, or x-direction, load that would tend to urge spanning member 30 to disengage. The static load is most typically a vertical shear load, and, in buildings, live loads may tend also to be vertical loads. For structural purposes the connection between the spanning member and the structural support assembly may be modelled as, and can be considered herein to be, a pin jointed connection that transmits vertical shear, but not a bending moment, between spanning member 30 and wall assembly 20.

In the event of a fire, such as may cause spanning member 30 to collapse, it is desirable for spanning member 30 to disengage from wall assembly 20 rather than remain engaged and tend to pull wall assembly 20 down with it. In that light, the bolted connection may be considered a sandwich under a mechanical spring pre-load, in which bolt 58 functions as a longitudinal spring in tension, and members captured between nut 94 and the head of bolt 58 function as an opposed longitudinal spring in compression. As long as this relationship persists, the connection will tend to inhibit disengagement of the spanning member from the bracket—e.g., by linear translation in the x-direction.

In the event that there is a fire in the adjacent zone, identified notionally as room 100, and second part 44 is exposed either to open flame or to elevated temperatures for a sufficient period of time (e.g., 350+° F. (180° C.) for 10 minutes or more), the structural integrity of part 44 degrades, such that the compressive stress in the sandwich (and therefore the tensile stress in bolts 58) is released. This may occur because part 44 melts, or crumbles, or burns, as may be. When the preload in the sandwich and bolt combination is thereby lost, the end of the spanning member can pull out. (In the alternate embodiment of FIG. 2*h*, this motion would tend then to tear fragile webs 106.) Second part 44 (or 98, as may be) can in that sense also be termed a sacrificial member.

Second part 44 can also be thought of conceptually as a thermal fuse. When a thermal overload condition occurs, the fuse melts (or otherwise degrades), and the spring load in the mechanical sandwich relaxes thereby diminishing or eliminating the retention capability or function of the connection. When the fuse has been activated in this way, end 34 of spanning member 30 is disengageable along the degree of freedom defined by longitudinal translation in the x-direction away from the structural datum member, namely the wall structure. End 34 continues to be inhibited by the slots from freedom of motion in the y direction, and by the plate itself, i.e., leg 50, in the z-direction. Of course, that the thermal fuse, member 44, has undergone thermal degradation, thus permitting motion along the sliding translational degree of freedom, does not mean that the beam will necessarily disengage. It may continue to be supported by hangar 42, carrying the ordinary loads in the ordinary manner. The mere degradation of the fuse is a necessary, but not sufficient, prerequisite condition for disengagement to occur. However, if that condition is met, and there is then applied a lateral load, or component of load or other cause to urge the end of the beam to disengage in that lateral, or normal, or cross-wise direction relative to the wall structure, disengagement will follow. Where degradation occurs, but is not followed by disengagement (the fire is safely extinguished in good time, for example), the consumable or degradable member no longer serves to prevent lateral motion. However, in as much as the consumable member remains exposed and therefore accessible for inspection, it can be replaced as appropriate. Since the consumable member is on the outside, below the load bearing bracket, it can be removed and replaced while the beam end remains in place on the bracket.

In an alternate embodiment, shown in FIG. 2*h*, the sacrificial member could be placed between the bracket and end 34 of the spanning member 30. However, in the embodiment illustrated there is no separation, or sacrificial member, between the spanning member and the seat on the support bracket. Rather, the foot (i.e., end 34) of spanning member 30 is above, and rests upon seat (i.e., leg 50), and the fuse or degradable member 44 is carried below, or on the underside of, the seat. Thus, even if the fuse is activated, spanning member 30 will not necessarily move. It may stay in place on support bracket 46, as before, without any movement. Alternatively a non-degrading gasket or shim, which may be thermally or electrically insulating, may be placed between end 34 and cantilevered leg 50 as, for example, when adjustment of end 34 is desired to level spanning member 30.

As noted above, if, on investigation, inspection shows that one of the fuses has, for example, melted, or that the tension in bolts 58 has been lost, indicating physical degradation of second member 44, then bolts 58 can be loosened, the worn out member 44 removed, a new "fuse" member 44 installed, and bolts 58 re-tightened to an appropriate value of tension. This replacement may tend to be considerably less difficult than if the sacrificial member were between the spanning member and the seat.

In the alternate embodiment of FIGS. 3*a*-3*e*, rather than being a bracket, a support assembly 110 includes a first part or base member that may have the form of a channel, 120, and a second part that may be substantially the same as second part 44 of assembly 40. Channel 120 includes a back 122 and legs 124, 126 laterally spaced apart a sufficient distance to accommodate the end of spanning member 30 therebetween. Lengthwise, channel 120 has a first portion 128 and a second portion 130. First portion 128 is embedded in firewall 20 in a built-in connection, with back 122 being located, for example, in the midst of a layer of mortar 134 between cinder blocks 136, 138. To aid in embedding this mounting, a threaded socket 140 may be captured in the concrete fill, and a threaded fastener, or fasteners, 142 may pass through bores 144 in first part 128, thereby fixing it in place.

Second portion 130 is the cantilevered overhanging end of channel 120 that protrudes from firewall 20. Second portion 130 has slots 146, 148 which may be substantially the same as slots 66, 68 in terms of function and general geometry or geometric relationship. Second part 130 also has an indexing or slip plate retention member, or retainer, 150, which may have any of the forms discussed above, whether a detent, or plug, or blister, or rod, or other form. Second part 44 mates with first part, 120, as described above. On assembly, bolts 58 and nuts 94 can be used as before. As installed and assembled, the end of the spanning member sits in the channel, and its vertical load is passed into the channel section and into the wall structure. As before, the connection is not intended to transmit a bending moment, and may be analysed as a simply connected pin joint. The ordinary load is a static gravity load, the direction of that load, as above, most typically being vertical and parallel to the wall surface. Second portion 130 is oriented to support the normal load without the beam moving, even if there is no fuse member in place. In operation, the failure of the fuse is again intended to permit spanning member 30 to pull away from wall assembly 20. And, again, as noted above, degradation of the fuse is a necessary, but not sufficient, pre-requisite condition for disengagement of the beam from channel second portion 130.

In assembly 110, as in assembly 40, notwithstanding degradation of the fuse, the structure maintains its integrity in respect of bearing loads in the z or vertical direction, and also maintains its integrity in preventing or restraining escape in the direction along the wall in the y-direction. Disengagement occurs when there is a further lateral force, an abnormal, or dislocating, or disengaging force, normal to, or transverse to, or cross-wise to the wall structure, resulting in displacement of the beam end in translation away from the wall structure in the direction of the degree of freedom permitted by the degradation of the fuse. Again, the fuse is located outside the back of the channel second portion 130, such that it is exposed for inspection, accessible for inspection, and accessible for replacement. As above, replacement can take place without the end of the spanning member being disengaged from the seat defined by channel second portion 130.

Although specific embodiments have been shown and described, the features of the various embodiments may be mixed-and-matched as may be appropriate. Channel 120 may have an array of retention or indexing features such as items 112 of FIG. 2*h*, and may be used in conjunction with a slip plate having slots with closed peripheries, as may be. The mounting hardware may pass through the full depth of the beam ends, or merely through the bottom flange or flanges of the beam. The slip plate may have closed ended slots, and yet use an indexing accommodation such as item 90. Such other combinations and variations of the features shown and described herein may be used as suitable without need of proliferation of illustrations and redundant explanation of each combination or permutation.

Various embodiments of the invention have been described in detail. Since changes in and or additions to the above-described best mode may be made without departing from the nature, spirit or scope of the invention, the invention is not to be limited to those details but only by the appended claims.

I claim:

1. A self-releasing structural support assembly, said assembly comprising:

a first member and a second member;

said first member being made of a fireproof material;

said first member having a first portion and a second portion;

said first portion of said first member defining an anchor member by which said first member can be permanently secured to a structural reference datum member, and through which, when installed, a shear load can be passed into the structural reference datum member;

said second portion of said first member defining a reaction seat upon which to carry a foot of a spanning member and through which to receive a shear load from the spanning member;

said second portion of said first member having a spanning member securement accommodation;

said second portion of said first member having a first indexing member;

said second member being one of (a) fire degradable;

(b) temperature degradable said second member having a spanning member securement retention fitting that is co-operable with said spanning member securement accommodation;

said second member having a second indexing member;

on installation, said second indexing member of said second member being in mating cooperation with said first indexing member of said first member, and in operation, when so mated, said second member being secured in a position preventing disengagement of the spanning member; and in operation, when said second member is degraded by either one of (a) fire and (b) heat, the spanning member is insecure from disengagement from the first member.

2. The self-releasing structural support assembly of claim 1, wherein, when installed, said seat is upwardly facing and said second member is located below said seat.

3. The self-releasing structural support assembly of claim 1, wherein, as installed, the condition of said second member is ascertainable, and said second member is replaceable, while the foot of the spanning member remains supported by the seat.

4. The self-releasing structural support assembly of claim 1, wherein said first member is mountable to a substantially planar wall, and, when mounted to such substantially planar wall, said spanning member securement accommodation of said structural support assembly has a degree of freedom of linear translation substantially normal to said wall, and said seat has a range of accommodation positions for the foot of the spanning member along said degree of freedom.

5. The self-releasing structural support assembly of claim 4, wherein said range of accommodation positions is at least 2 inches long.

6. The self-releasing structural support assembly of claim 1, wherein said first member is one of:

(a) an angled member having a first leg for mounting to a wall, and a second, cantilevered leg that stands outwardly of the wall when the first leg is mounted thereto; and (b) a channel member having two legs and a back extending therebetween, such that when said channel member is embedded in a wall said back thereof is substantially horizontal and defines said seat.

7. The self-releasing structural support assembly of claim 1, in combination with embedment anchor hardware, said anchor member having fittings defined therein cooperable with said hardware.

8. The self-releasing structural support assembly of claim 1 in combination with beam engagement fittings, said beam engagement fittings being threaded fasteners, said spanning member securement accommodation defining slots, wherein, in use, said second member, said second portion of said first member, and the foot of the spanning member are stacked together in a sandwich, and said threaded fasteners secure said sandwich, said sandwich being in compression and said threaded fasteners being in tension.

9. The self-releasing structural support assembly of claim 8, wherein said first member is one of:

(a) an angled member having a first leg for mounting to a wall, and a second, cantilevered leg that stands outwardly of the wall when the first leg is mounted thereto; and (b) a channel member having two legs and a back extending therebetween, such that when said channel member is embedded in a wall said back thereof is substantially horizontal and defines said seat;

said first member is mountable to a substantially planar wall, and when mounted to such substantially planar wall, said spanning member securement accommodation includes at least a first slot, said first slot having a degree of freedom of linear translation substantially normal to said wall, and said seat has a range of accommodation positions for the foot of the spanning member along said degree of freedom;

when installed, said seat is upwardly facing and said second member is located below said seat;

as installed, the condition of said second member is ascertainable; and said second member is replaceable while the foot of the spanning member remains supported by the seat.

10. The self-releasing structural support assembly of claim 9, further including the spanning member.

11. A self-releasing beam end support assembly, said assembly comprising:

a support fitting and a consumable member:

said support fitting defining a seat upon which to support a beam end, and defining an anchor by which to attach said support fitting to a wall structure, and, once installed, by which to transfer ordinary loads from the beam to the wall structure;

said consumable member and said support fitting having co-operating beam fastener accommodations;

said consumable member and said support fitting having mutually co-operating engagement fittings constraining location of said consumable member relative to said support fitting;

said consumable member being one of (a) thermally degradable; and (b) fire degradable; and in operation, under a first, non-degraded condition of said consumable member, said support fitting and said consumable member being co-operable with a beam fastener to discourage dislodgement of the beam end from said seat; and in operation, under a second, degraded, condition of said consumable member, (a) said support fitting remaining operable to carry said ordinary loads, and (b) said support fitting and said consumable member being co-operable to permit release of the beam end from said seat under abnormal loading.

12. The self-releasing beam end support assembly of claim 11, wherein:

in ordinary loading said support assembly is operable to transfer vertical loads of said beam into said wall structure; and in said degraded condition of said consumable member said end support assembly remaining operable to transfer said vertical loads, yet also permitting a degree of freedom of motion of said beam end normal to said wall structure whereby said beam end can move away from said wall structure.

13. The self-releasing beam support assembly of claim 11, wherein, as installed, said seat is upwardly facing and said consumable member is located below said seat.

14. The self-releasing beam support assembly of claim 11, wherein, as installed, the condition of said consumable member is ascertainable, and said consumable member is replaceable, while the beam end remains supported by the seat.

15. The self-releasing beam support assembly of claim 11, wherein said support fitting is mountable to a substantially planar wall, and when mounted to such substantially planar wall, said beam fastener accommodations of said support fitting have a degree of freedom of linear translation substantially normal to said wall, and said seat has a range of accommodation positions for the beam end along said degree of freedom.

16. The self-releasing beam support assembly of claim 15, wherein said range of accommodation positions is at least 2 inches long.

17. The self-releasing beam support assembly of claim 11, wherein said support fitting is one of:

(a) an angled member having a first leg for mounting to a wall, and a second, cantilevered leg that stands outwardly of the wall when the first leg is mounted thereto; and (b) a channel member having two legs and a back extending therebetween, such that when said channel member is embedded in a wall said back thereof is substantially horizontal and defines said seat.

18. The self-releasing beam support assembly of claim 11 in combination with embedment anchor hardware, said beam support assembly having fittings defined therein cooperable with said hardware.

19. The self-releasing beam support assembly of claim 11 in combination with beam engagement fittings, said beam engagement fittings being threaded fasteners, said beam fastener accommodations defining slots, wherein, in use, said consumable member, said support fitting, and a beam end are stacked together in a sandwich, said threaded fasteners securing said sandwich, said sandwich being in compression and said threaded fasteners being in tension.

20. The self-releasing beam support assembly of claim 19, wherein said support fitting is one of:

(a) an angled member having a first leg for mounting to a wall, and a second, cantilevered leg that stands outwardly of the wall when the first leg is mounted thereto; and (b) a channel member having two legs and a back extending therebetween, such that when said channel member is embedded in a wall said back thereof is substantially horizontal and defines said seat;

said support fitting is mountable to a substantially planar wall, and, when so mounted, said beam fastener accommodations of said support fitting include at least a first slot, said first slot having a degree of freedom of linear translation substantially normal to said wall, and said seat having a range of accommodation positions for the beam end along said degree of freedom;

when installed, said seat is upwardly facing and said consumable member is located below said seat; and as installed, the condition of said consumable member is ascertainable, and said consumable member is replaceable, while the beam end remains supported by the seat.

21. The self-releasing beam support assembly of claim 20, further including the beam.

22. The combination of a firewall, a first self-releasing beam end support assembly and a second self-releasing beam end support assembly, wherein:

the firewall has a first face and a second face;

said first self-releasing beam end support assembly is mounted to said firewall and extends outwardly away from said first face thereof;

said second self-releasing beam end support assembly is mounted to said firewall and extends outwardly away from said second face thereof;

said first and second self-releasing beam end support assemblies are segregated from each other such that they are impeded from transmitting heat or flame from one to another;

each of said beam end support assemblies includes a support fitting and a consumable member;

said support fitting defining a seat upon which to support a beam end, and defining an anchor by which to attach said support fitting to said firewall, and, once installed, by which to transfer ordinary loads from the beam to said firewall;

said consumable member and said support fitting having co-operating beam fastener accommodations;

said consumable member and said support fitting having mutually co-operating engagement fittings constraining location of said consumable member relative to said support fitting;

said consumable member being one of (a) thermally degradable; and (b) fire degradable; and in operation, under a first, non-degraded condition of said consumable member, said support fitting and said consumable member being co-operable with a beam fastener to discourage dislodgement of the beam end from said seat; and in operation, under a second, degraded, condition of said consumable member, (a) said support fitting remaining operable to carry a static load, and (b) said support fitting and said consumable member being co-operable to permit release of the beam end from said seat under abnormal loading.

* * * * *